United States Patent [19]

Stephens

[11] Patent Number: 4,513,293

[45] Date of Patent: Apr. 23, 1985

[54] FREQUENCY SELECTIVE ANTENNA

[75] Inventor: Kenneth D. Stephens, St. Just, P.R.

[73] Assignee: Communications Design Group, Inc., Nashville, Tenn.

[21] Appl. No.: 320,722

[22] Filed: Nov. 12, 1981

[51] Int. Cl.[3] ..... H01Q 15/16

[52] U.S. Cl. ..... 343/840; 343/914

[58] Field of Search ..... 343/840, 908–910, 343/912–914; 350/288, 293, 294

[56] References Cited

U.S. PATENT DOCUMENTS 1,906,546 5/1933 Darbord ..... 343/912

FOREIGN PATENT DOCUMENTS 132272 12/1931 Austria ..... 343/840
587110 1/1959 Italy ..... 343/912
134802 10/1981 Japan ..... 343/912

OTHER PUBLICATIONS

"*Satellite Broadcasting: A Zoned Reflector Aerial for the Domestic Reception of Band VI*", British Broadcasting Corporation Research Department, Report No. 1972/10.

*Primary Examiner*—Eli Lieberman

*Assistant Examiner*—Michael C. Wimer

*Attorney, Agent, or Firm*—Lyon & Lyon

[57] ABSTRACT

There is disclosed herein an antenna, particularly for use at high frequencies such as approximately one gigahertz and above, which is frequency selective. The antenna design allows signals at a given frequency to be preferentially received, as distinguished from broadband reception. The antenna design can be modified for reception of signals of different given frequencies. The antenna comprises a plurality of parabolic sections in the form of concentric rings or segments with each segment being offset axially from the next adjoining segment to thereby provide an antenna which is relatively flat, or having a low profile, as compared to a standard parabolic antenna. The surface of each segment is a segment of a different focal length parabola, but with each parabolic surface being a function of the signal wavelength (or frequency) to be received by the antenna. The antenna may be round, rectangular or have other shapes. Also disclosed are feed and pick-up arrangements for the antenna. In addition to the frequency selective characteristic of the antenna it can be made from various materials and is relatively simple to manufacture, and its low profile minimizes wind loading and mounting problems, and the like.

13 Claims, 11 Drawing Figures

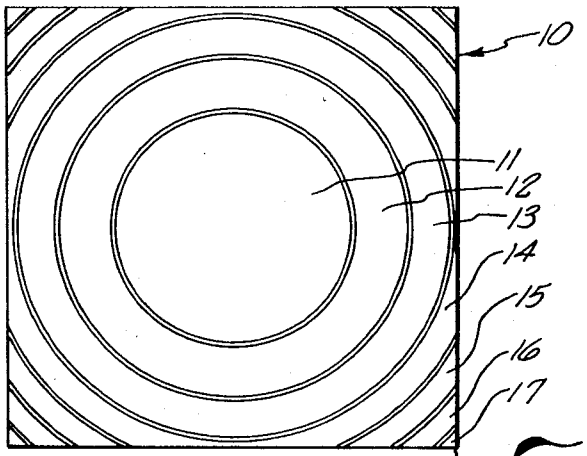
FIG. 2
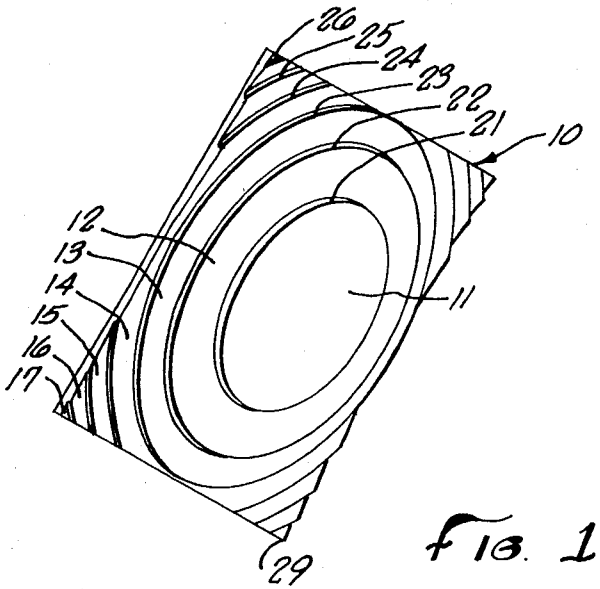
FIG. 1
FIG. 3a
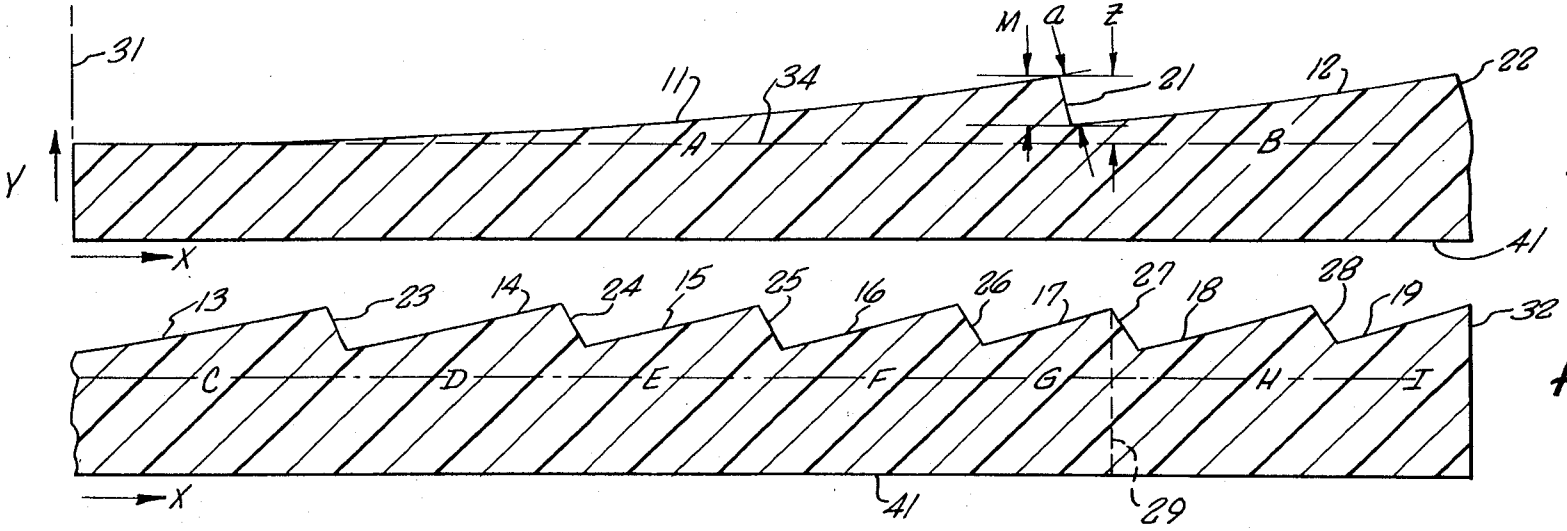
FIG. 3b

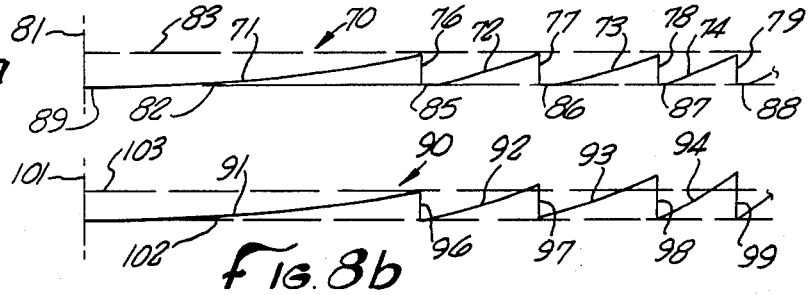
FIG. 8a
FIG. 8b
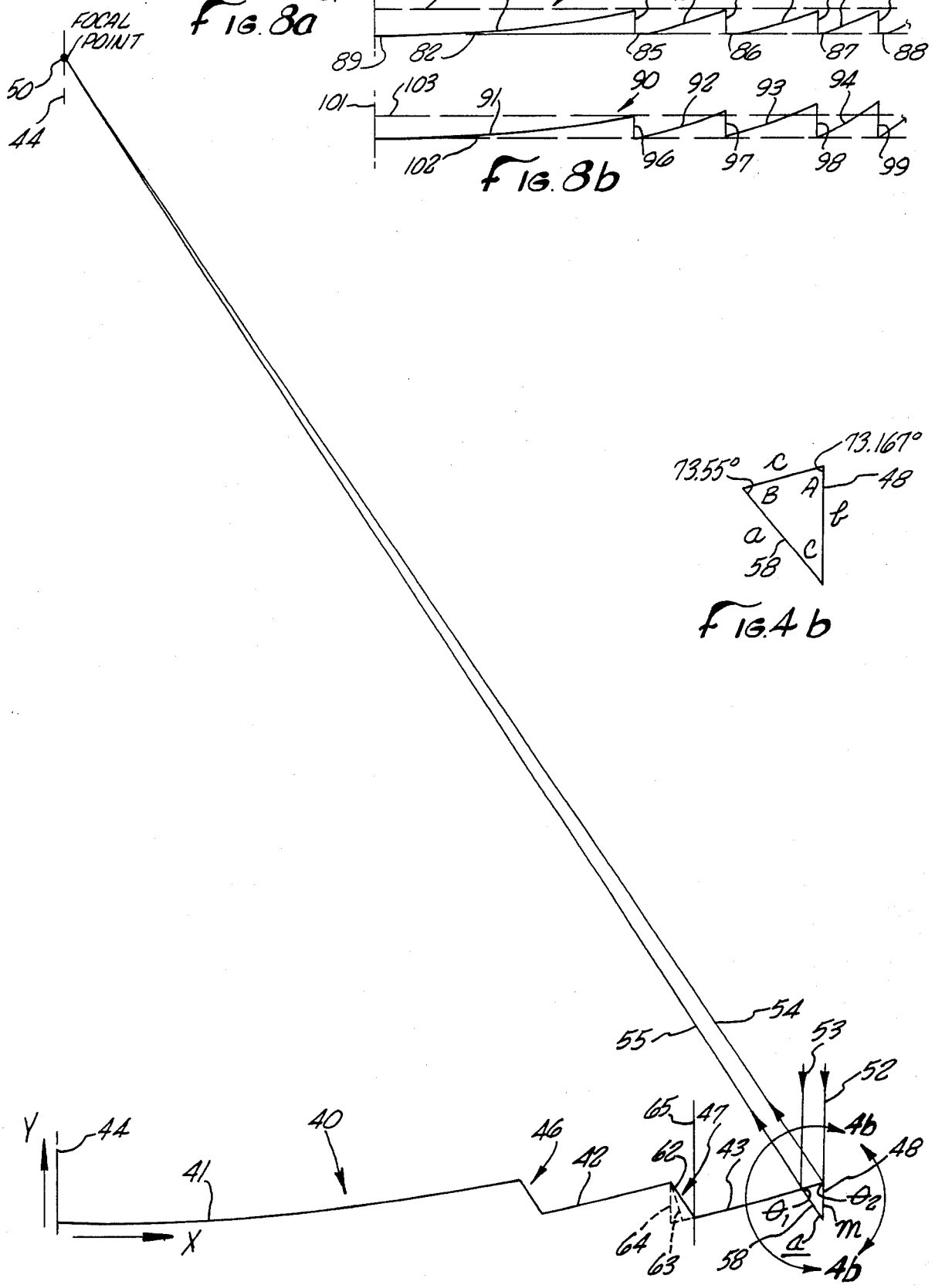
FIG. 4b
FIG 4a

FREQUENCY SELECTIVE ANTENNA

BACKGROUND OF THE INVENTION

The present invention relates to antennas, and more particularly to frequency selective antennas generally of the parabolic form and used at high frequencies.

Various forms of antennas have been developed and used for many years. Numerous examples of the construction and use of antennas are given in The ARRL Antenna Book published by the American Radio Relay League, Inc., copyrighted in 1974. While antennas vary from a simple wire to complex Yagis, parabolic dishes and the like, a commonly used antenna presently for the reception of high frequency signals is the parabolic dish because of its high-gain characteristic. They are broadband antennas, although the feed horn can be designed to be reasonably frequency selective, and the efficiency of parabolic antennas does not change significantly with size. However, these antennas tend to be large and bulky, heavy, difficult to construct, have large wind-loading surfaces, are unsightly, and are expensive to manufacture.

On the other hand, the present invention provides a high gain antenna that overcomes most of the disadvantages of a parabolic antenna and is an antenna which is highly frequency selective. It is frequency selective to a frequency or small band of frequencies at or near the design wavelength and multiples thereof, and completely cancels signals at one-half the design wavelength and odd multiples thereof. An antenna of the present invention can be manufactured at relatively low cost, and is useful for microwave, radar, satellite and the like communications and reception, and for multipoint distribution systems for television and relay paths, including optical reflection, and other uses where select frequencies need to be reinforced through in-phase gathering at a focal point.

An antenna constructed in accordance with the teachings of the present invention comprises a plurality of parabolic segments each having a different parabolic surface related to the frequency involved, and each offset axially from the next. The antenna is relatively thin or has a narrow or low profile. This significantly reduces wind-loading factors and provides a more aesthetically and environmentally pleasing, or less obtrusive, antenna particularly for use in direct reception of satellite television signals such as by individuals in residential areas. If used, for example, on the roof of a residence this antenna would be significantly less obtrusive than a parabolic dish designed to receive signals of a similar frequency. The antenna is relatively simple to construct, and its form can be modified readily for the reception of a different frequency or narrow frequency band. The antenna can be constructed of various materials and be manufactured using numerous conventional techniques.

SUMMARY OF THE INVENTION

According to the present invention, there is provided an improved form of frequency selective antenna.

Another feature of the present invention is the provision of a frequency selective antenna for use with relatively high frequency signals and which is relatively thin or has a narrow profile.

Another feature of the present invention is the provision of an antenna which is relatively simple to construct.

A further feature of the present invention is an improved antenna which can be simply designed to preferentially receive signals of various frequencies.

BRIEF DESCRIPTION OF THE DRAWINGS

These and other objects and features of the present invention will become better understood through a consideration of the following description taken in conjunction with the drawings in which:

FIG. 1 is a perspective view of an antenna according to the present invention:

FIG. 2 is a plan view of the antenna of FIG. 1;

FIGS. 3*a*–3*b* comprise a cross-sectional view of one-half of an antenna according to the present invention;

FIGS. 4*a*–4*b* comprise diagrams illustrating certain geometrical relationships used in the manufacture of an antenna according to the present invention;

FIGS. 8*a*–8*b* are diagrammatic and fragmentary views like FIG. 3 and illustrate alternate forms of the antenna.

DETAILED DESCRIPTION

Figure 5:
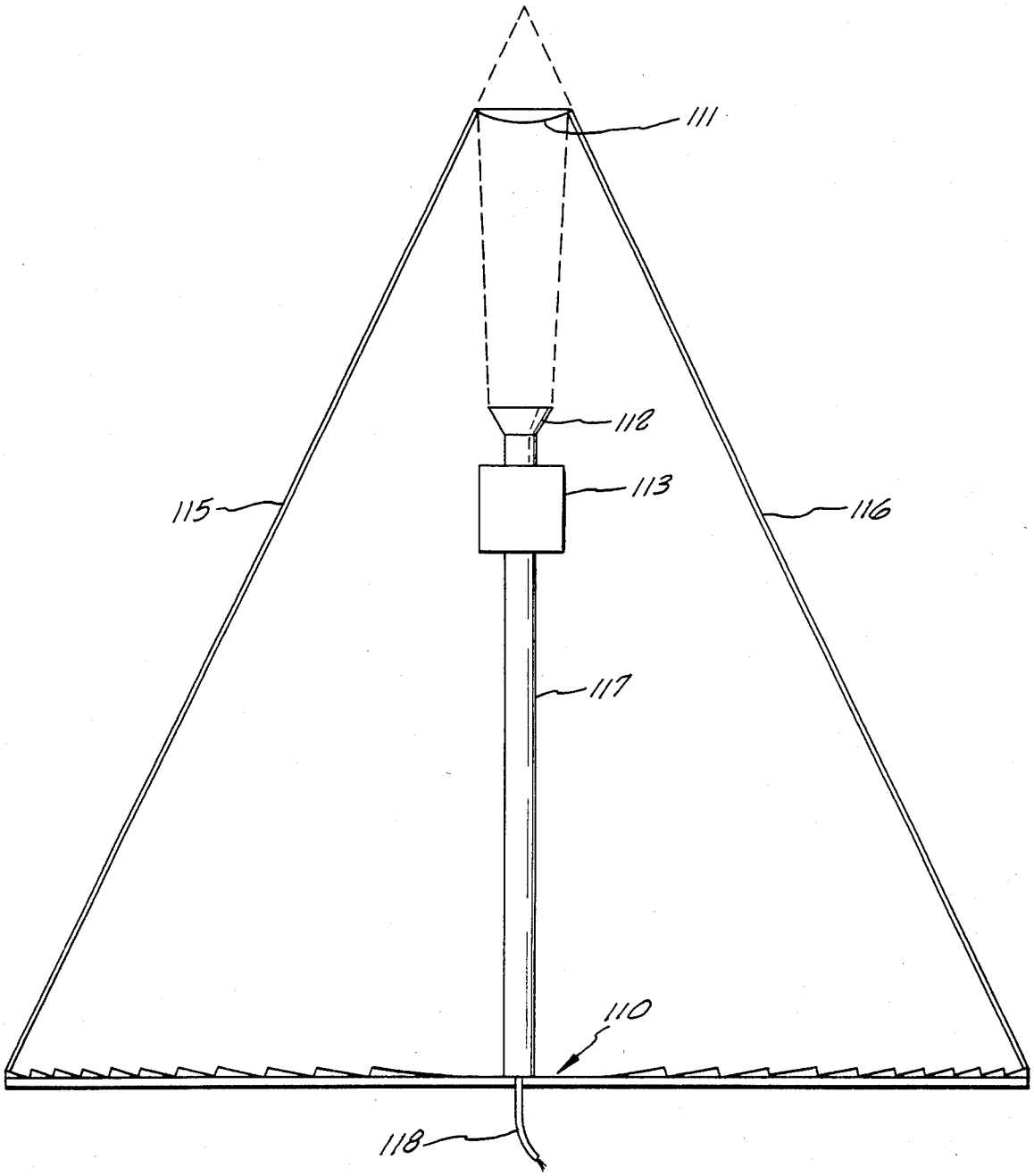
FIGS. 5–7 illustrate alternative feed arrangements for an antenna of the present invention.

Turning now to the drawings, and first to FIGS. 1 and 2, an antenna 10 is shown which is rectangular in exterior configuration, although it could be round or have other shapes. The antenna 10 includes a central segment 11 which is circular but has a parabolic surface, and further includes segments 12 through 17 which are in the form of concentric rings. Each of the rings 12–17 also has a parabolic surface; however, each parabolic surface 11–17 is based on a different focal length parabola but each is related to the wavelength or frequency of the signal to be received by the antenna. It should be noted that the antenna of the present invention will be discussed as a receiving antenna, but it likewise can be used as a transmitting antenna. Since each of the segments 12–17 is off set axially (in a direction toward the back of the antenna as seen in FIGS. 1 and 2) ridges or shoulders 21 through 26 exist between the respective segments. The amount of axial off-set, the focal length and other parameters pertaining to the segments of the antenna will be discussed subsequently. FIGS. 3*a* and 3*b*, which will also be discussed later, illustrate the relatively low or thin profile of an antenna of FIGS. 1–2.

The exemplary antenna 10 shown in FIGS. 1 and 2 is for a center frequency of 12.5 GHz (wavelength 2.4 cm), a prime focal length of one meter, an Fl/d of 0.82, and each side has a length of approximately one meter. This design is based on the antenna having an overall radius (to edge 29 of segment 17) of 62 cm, or an overall diameter of 124 cm. Thus, if all of the segments 14 through 17 were complete rings, rather than cut-off (segments 14–17) to form a square antenna, the antenna would have a diameter of four feet. The antenna can be smaller or larger, and in the latter case additional segments past segment 17 can be provided. The active area of the antenna as shown in FIGS. 1 and 2 is approximately one square meter (approximately ten square feet), while the total thickness (from the back surface of the antenna to the forwardmost edges of the ridges 21–26) is approximately four centimeters (the deviation of the ridges or shoulders is a maximum of about two centimeters and the base or backing structure of the antenna is about two centimeters). While this antenna has a maximum thickness of approximately four centimeters, an equivalent parabolic antenna having a diameter of 124 cm and a focal length of 100 cm would have a maximum excursion at the outer edge of 9.6 cm plus any thickness the antenna structure may have at the center (assuming approximately 2 cm, then the antenna would have a maximum thickness or profile of about 11.6 cm). If the antenna had a diameter of 142 cm as is shown in FIGS. 3*a*–3*b* which will be discussed below, then the maximum excursion at the outer edge would still be about four centimeters; whereas a standard parabola would be 12.6 cm (plus whatever backing structure is used). Thus, it will be apparent that an antenna constructed according to the teaching of the present invention has a significantly smaller thickness or lower profile, particularly as the diameter or width of the antenna is increased.

FIGS. 3*a*–3*b* provide a cross-sectional view of one-half of an antenna like that of FIGS. 1 and 2 (when FIGS. 3*a*–3*b* are placed with the right end of FIG. 3*a* abutting the left end of FIG. 3*b*), but with two extra segments as will be noted below. FIGS. 3*a*–3*b* better illustrate a typical thickness of the overall antenna, and dashed line 29 in FIG. 3*b* denotes the edge 29 of the segment 17 as seen in FIGS. 1 and 2. The antenna includes a parabolic central section or surface 11 like that of FIGS. 1–2, and parabolic ring surfaces 12 through 17. Additional surfaces 18 and 19, along with ridges 27 and 28 are shown for the antenna of FIGS. 3*a*–3*b*, and more segments could be provided if desired. Table I which appears later provides the data for an antenna like FIGS. 1 through 3 but which has even more segments and goes up to a diameter of 200 centimeters. It should be noted that FIGS. 3*a*–3*b* show only one-half of the antenna from the center of the central section at a central Y axis 31 of the antenna to an outer edge 32 of the antenna (with line 29 forming the outer edge in the case of the antenna of FIGS. 1 and 2).

The antenna of FIGS. 3*a*–3*b* may be thought of as comprising zones or segments A through I in which the respective central surface 11 and ring surfaces 12–19 are formed. Since each succeeding ring segment B through I is off-set axially toward the rear surface 41 of the antenna, the ridges or shoulders 21–28 exist between the various segments A through I. The angles of these shoulders are selected, as will be described subsequently, to minimize the side lobe radiation that gets into the antenna feed; that is, the radiation which enters the antenna off-axis from the side of the antenna and reflects off of the surfaces of the shoulders 21–28 toward the antenna feed.

The antenna as shown in FIGS. 1–3 can be readily formed by pouring a resin along with fiberglass matting into a mold. It can be molded to a thickness of the nature shown in FIGS. 3*a*–3*b* or, alternatively, the upper half of the antenna as seen in FIGS. 3*a*–3*b* can be molded in this manner and a foam or other backing added thereto for providing further rigidity but for minimizing the overall weight of the antenna. Any suitable means for mounting the antenna can be provided, as by embedding suitable studs or nuts into the rear surface of the antenna, mounting flanges along the edges of the antenna, and the like. An alternative form of construction using a metal stamping or stampings will be discussed in connection with the discussion of FIGS. 8*a*–8*b*.

Considering now the design of an antenna according to the present invention, the following Table I (dimensions are in centimeters) provides detailed design data for an exemplary antenna of the nature shown in FIGS. 1 through 3, and FIGS. 4*a*–4*b* aid in understanding the relationship of the ridges between adjacent sections. Briefly, the antenna is considered to have a baseline 34 (FIGS. 3*a*–3*b*) with respect to which the various segments rise or deviate. This deviation or location with respect to the baseline 34 of the various surfaces (e.g., surface 11 of FIG. 3*a*) is defined by a dimension Z. The dimension Z varies with the dimension X, and X represents the horizontal distance outwardly from the central Y axis 31 of the antenna and is perpendicular to that axis. The surface of each section of the antenna (e.g., surface 11) at any point thereon makes a particular angle with respect to incoming radiation parallel to the axis 31 (and this angle likewise is the antenna surface angle with respect to the axis 31 itself), and the particular point is at a given horizontal distance X from the axis 31.

TABLE I

| Sect. No. | $F_L$ | X | FLo/X | $\theta$ | Z | M |
|---|---|---|---|---|---|---|
| A | 100(FLo) | 0 | — | 90° | .000 | |
| A | 100 | 10 | 10.00 | 87°10′ | .250 | |
| A | 100 | 20 | 5.00 | 84°20′ | 1.000 | |
| A | 100 | 25 | 4.00 | 83°00′ | 1.563 | 1.216 |
| B | 101.2 | 25 | 4.00 | 83°00′ | .344 | |
| B | 101.2 | 30 | 3.33 | 81°40′ | 1.023 | |
| B | 101.2 | 35 | 2.86 | 80°10′ | 1.826 | 1.235 |
| C | 102.4 | 35 | 2.86 | 80°10′ | .591 | |
| C | 102.4 | 40 | 2.50 | 79°05′ | 1.506 | |
| C | 102.4 | 42 | 2.38 | 78°36′ | 1.907 | 1.250 |
| D | 103.6 | 42 | 2.38 | 78°36′ | .657 | |
| D | 103.6 | 45 | 2.22 | 77°53′ | 1.287 | |
| D | 103.6 | 48 | 2.08 | 77°10′ | 1.960 | 1.264 |
| E | 104.8 | 48 | 2.08 | 77°10′ | .696 | |
| E | 104.8 | 50 | 2.00 | 76°42′ | 1.164 | |
| E | 104.8 | 53 | 1.89 | 76°05′ | 1.901 | 1.276 |
| F | 106.0 | 53 | 1.89 | 76°05′ | .625 | |
| F | 106.0 | 55 | 1.82 | 75°35′ | 1.134 | |
| F | 106.0 | 58 | 1.72 | 74°57′ | 1.934 | 1.289 |
| G | 107.2 | 58 | 1.72 | 74°57′ | .645 | |
| G | 107.2 | 60 | 1.67 | 74°35′ | 1.196 | |
| G | 107.2 | 62 | 1.61 | 74°05′ | 1.765 | 1.300 |
| H | 108.4 | 62 | 1.61 | 74°05′ | .465 | |
| H | 108.4 | 65 | 1.54 | 73°30′ | 1.344 | |
| H | 108.4 | 67 | 1.49 | 73°05′ | 1.953 | 1.313 |
| Sec. No. | $F_L$ | X | FLo/x | $\theta$ | Z | M |
| I | 109.6 | 67 | 1.49 | 73°05′ | .640 | |
| I | 109.6 | 70 | 1.43 | 72°30′ | 1.577 | |
| I | 109.6 | 71 | 1.41 | 72°20′ | 1.899 | 1.325 |
| J | 110.8 | 71 | 1.41 | 72°20′ | .574 | |
| J | 110.8 | 75 | 1.33 | 71°35′ | 1.892 | 1.336 |
| K | 112.0 | 75 | 1.33 | 71°35 | .556 | |
| K | 112.0 | 79 | 1.27 | 70°50′ | 1.931 | 1.348 |
| L | 113.2 | 79 | 1.27 | 70°50′ | .583 | |
| L | 113.2 | 82 | 1.22 | 70°20′ | 1.650 | 1.356 |
| M | 114.4 | 82 | 1.22 | 70°20′ | .294 | |
| M | 114.4 | 85 | 1.18 | 69°50′ | 1.389 | |
| M | 114.4 | 86 | 1.16 | 69°37 | 1.763 | 1.368 |
| N | 115.6 | 86 | 1.16 | 69°37′ | .395 | |
| N | 115.6 | 90 | 1.11 | 69°00′ | 1.917 | 1.380 |
| O | 116.8 | 90 | 1.11 | 69°00′ | .537 | |
| O | 116.8 | 93 | 1.08 | 68°35′ | 1.712 | 1.388 |
| P | 118.0 | 93 | 1.08 | 68°35′ | .324 | |
| P | 118.0 | 95 | 1.06 | 68°20′ | 1.121 | |
| P | 118.0 | 97 | 1.03 | 67°55′ | 1.934 | 1.400 |
| Q | 119.2 | 97 | 1.03 | 67°55′ | .534 | |
| Q | 119.2 | 100 | 1.00 | 67°30′ | 1.773 | |

A particularly important parameter is a dimension M which, in general terms, represents the displacement in a direction parallel to the central axis 31 where the axial transition from one segment to another occurs (e.g., like at ridge 21 as seen in FIG. 3*a*). The parameter M is a function of the wavelength, and M has a lower limit value of one-half the wavelength measured at the Y axis 31 and this limit establishes the starting point and lower limit for the dimension M (although no ridge or transition is actually made in the center of the antenna at the Y axis 31). As will be seen from Table I, the dimension M always increases with an increasing horizontal distance X from the central axis. M is slightly greater, but almost equal to, a distance "a" which is the distance between the surfaces of adjacent segments (note FIGS. 3*a* and 4*a*–4*b* which will be discussed in more detail subsequently) along a radial line to the focal point of the antenna.

The manner in which the particular position of the ridges (e.g., ridge 21) or transitions is selected is by setting an arbitrary limit on the dimension Z, and when this limit is approached or reached as the dimension X increases, a transition is made. An example arbitrary limit for the dimension Z, and as used in Table I, is two centimeters. Its lower limit generally preferably is zero. It will be noted from Table I that Z was not allowed to reach two centimeters. This was done for convenience in selecting the transition points at an even value of X. FIG. 8*a*, which will be discussed later, shows an example where Z goes to the arbitrary upper limit in each instance.

Looking at Table I along with FIG. 3, it will be seen that the surface 11 of the first segment or zone A starts at the baseline 34 at the axis 31 with a Z of zero and rises from the baseline 34 following a parabolic curve. At a distance X of 25 centimeters, the dimension Z has increased to 1.56 centimeters. A transition of M equal to 1.216 centimeters is made which results in the ridge 21, although this transition could have been made at a higher value of X where Z would be even closer to two centimeters. At this transition point, the dimension Z drops to 0.344 centimeters, and then again rises as X increases, resulting in the parabolic surface 12, to 1.826 centimeters at an X distance of 35 centimeters. Then, the M transition of 1.235 centimeters is made at X of 35 centimeters, with the dimension Z dropping back to 0.591. Table I provides the data for the remaining segments of the antenna of FIG. 3*a*–3*b* on through segment 19 of zone I for an antenna having a radius of 71 centimeters or a diameter of 142 centimeters. The data in Table I is for the antenna embodiment of FIGS. 1–3 and, as noted earlier, has a center frequency of 12.5 GHz, a wavelength 2.4 centimeters and a prime focal length (namely, the focal length at the axis 31) of 100 centimeters or one meter. The Table I additionally provides data on out to a radius of 100 centimeters or a diameter of two meters. It should be stressed that the focal lengths, $F_L$, given in Table I are the focal lengths of the various segments of the antenna measured at the axis 31, and that the actual focal length at any point on any of the various antenna sections 11–19 varies according to the parabols equation, $Z=X^2/4F_L$ (for the central section, and $X^2/4F_{Ln}-[F_{Ln}-F_{Lo}]$) for succeeding rings n. While the focal lengths shown in Table I increase in one-half wavelength increments, the focal length change from one segment to the next (namely, the dimension "a" in FIGS. 3*a* and in FIGS. 4*a*–4*b*) is not one-half wavelength but actually increases from segment to segment by a small value, and "a" is approximately equal to the distance M as will be explained further in the discussion of FIGS. 4*a*–4*b*.

Set forth below are the mathematical relationships for determining the various parameters for antennas according to the present invention. The antenna prime focal distance can be defined as $F_{Lo}$, which in the example of Table I is 100 centimenters. The limits of Z are [90°, 45°], from the equation $$\tan(2\theta-90°) = \frac{F_{Lo}}{X}.$$

The variable distance M is determined as follows:

$$M = \frac{X^2}{4F_{L(n-1)}} - \frac{X^2}{4F_{Ln}} + \Delta F_L, \text{ or } M = (Z_{n-1} - Z_n)$$

where $\Delta F_L$ is the change in effective focal length from one antenna section to the next, but this is always measured by the antenna center axis 31. Thus, $\Delta F_L = F_{Ln} - F_{L(n-1)}$, where n is the particular antenna section (1 through 9 for the sections 11–19 of FIG. 3). $\Delta F_L$ is always an even multiple of one-half wavelength, and usually is one-half wavelength itself.

Thus, M designates the distance or transition in a direction parallel to the axis 31 from one section to the next and this distance is always greater than one-half wavelength as can be seen from Table I (wherein one-half wavelength is 1.2 centimeters and M varies from 1.216 up to 1.40 centimeters). The distance or excursion M could be twice as large, for example, for a higher frequency antenna, such as 24–25 $GH_Z$, to reduce the number of antenna sections needed. However, the antenna also will be frequency selective for one-half the selected design frequency. The displacement of each succeeding section by M ensures that each such section provides a path length which is an even multiple of the wavelength longer than that of each preceeding section so that all incoming parallel rays are reflected, and thus focused, precisely to the focal point of the antenna. The response curve for the antenna appears to follow a cosine wave wherein maximum frequency selectivity and gain occur at the center frequency, two-times the center frequency, and so on.

While specific design data for an exemplary antenna has been given above in Table I, it will be appreciated that antennas of other focal lengths, sizes, and so forth can be provided. In each instance the antenna effectively comprises a central parabolic section and a plurality of concentric parabolic ring sections and wherein the parabolic surface of each section is a different parabola and the focal length from one section to the next increases by more than one-half wavelength at the respective section. This provides an antenna that is frequency selective, as distinguished from being a broadband antenna, and one which is relatively thin or has a low profile compared to a standard parabolic dish. Data for another exemplary antenna is provided below in Table II and as will be apparent the antenna likewise has the form of FIGS. 1–3 (dimensions are in centimeters). This antenna is for a frequency of 12.0 $GH_z$ (wavelength of 2.5 cm), has a focal length of 48.8 cm, $F_{Lo}/d$ of 0.4 and a diameter of 122 cms.

| Sect. No. | $F_L$ | X | FLo/X | $\theta$ | Z | M |
|---|---|---|---|---|---|---|
| 1 | 48.8 | 0.0 | — | 90° | 0 | |
| 1 | 48.8 | 5.0 | 9.76 | 87.07° | .128 | |
| 1 | 48.8 | 10.0 | 4.88 | 84.21° | .512 | |
| 1 | 48.8 | 15.0 | 3.25 | 81.46° | 1.153 | |

-continued

| Sect. No. | $F_L$ | X | FLo/X | $\theta$ | Z | M |
|---|---|---|---|---|---|---|
| 1 | 48.8 | 17.0 | 2.87 | 80.40° | 1.481 | 1.287 |
| 2 | 50.05 | 17.0 | 2.87 | 80.40° | .194 | |
| 2 | 50.05 | 20.0 | 2.44 | 78.86° | .748 | |
| 2 | 50.05 | 23.0 | 2.12 | 77.38° | 1.392 | 1.314 |
| 3 | 51.3 | 23.0 | 2.12 | 77.38° | .078 | |
| 3 | 51.3 | 25.0 | 1.95 | 76.44° | .546 | |
| 3 | 51.3 | 28.0 | 1.74 | 75.03° | 1.321 | |
| 3 | 51.3 | 29.0 | 1.68 | 74.64° | 1.598 | 1.347 |
| 4 | 52.55 | 29.0 | 1.68 | 74.64° | .251 | |
| 4 | 52.55 | 33.0 | 1.48 | 72.97° | 1.431 | 1.371 |
| 5 | 53.8 | 33.0 | 1.48 | 72.97° | .060 | |
| 5 | 53.8 | 37.0 | 1.32 | 71.42° | 1.362 | |
| 5 | 53.8 | 38.0 | 1.28 | 71.05° | 1.710 | 1.402 |
| 6 | 55.05 | 38.0 | 1.28 | 71.05° | .308 | |
| 6 | 55.05 | 42.0 | 1.16 | 69.64° | 1.761 | 1.428 |
| 7 | 56.3 | 42.0 | 1.16 | 69.64° | .333 | |
| 7 | 56.3 | 45.0 | 1.08 | 68.66° | 1.492 | 1.445 |
| 8 | 57.55 | 45.0 | 1.08 | 68.66° | .047 | |
| 8 | 57.55 | 49.0 | .996 | 67.44° | 1.680 | 1.472 |
| 9 | 58.8 | 49.0 | .996 | 67.44° | .208 | |
| 9 | 58.8 | 52.0 | .938 | 66.59° | 1.497 | 1.490 |
| 10 | 60.05 | 52.0 | .938 | 66.59° | .007 | |
| 10 | 60.05 | 56.0 | .871 | 65.53° | 1.806 | 1.516 |
| 11 | 61.3 | 56.0 | .871 | 65.53° | .290 | |
| 11 | 61.3 | 59.0 | .827 | 64.8° | 1.697 | 1.534 |
| 12 | 62.55 | 59.0 | .827 | 64.8° | .163 | |
| 12 | 62.55 | 61.0 | .80 | 64.3° | 1.122 | 1.534 |

The manner in which the focal length change at the respective sections is computed is described below with respect to the discussion of FIGS. 4a–4b, and the manner in which the angle of the ridges (e.g., ridges 21 through 28) is selected also is described. In FIGS. 4a–4b the reference numeral 40 designates a diagrammatic form of the antenna like that shown in FIGS. 1–3 and which has several sections 41–43 extending outwardly from the central axis 44 and which has ridges 46 through 48. Also shown is the focal point 50 of the antenna, first and second incoming rays 52–53 which are parallel to the axis 44 and respective reflected rays 54–55 which are reflected from the surface 43 to the focal point 50. One purpose of FIG. 4 is to illustrate and aid in explaining the relationship between the parameter M (which is a distance parallel to the axis 44 as explained previously) and the distance "a" (which represents the focal length difference from one section to the next at a given horizontal position X). This example assumes a axial focal length (the axial distance from the center of surface 41 to the focal point 50) of fifteen inches and a wavelength of one inch for illustrative purposes. Table A below provides exemplary parameters (in inches) for the diagram of FIG. 4a, which diagram is approximately to two-thirds scale.

TABLE A

| $F_L$ | X | Z | M | $\theta$ |
|---|---|---|---|---|
| 15 | 2 | .0656 | — | |
| 15 | 4 | .2667 | — | |
| 15 | 6 | .6000 | .5194 | |
| 15.5 | 6 | .0806 | — | |
| 15.5 | 8 | .5323 | .5323 | |
| 16.0 | 8 | .0000 | — | |
| 16.0 | 9.7 | .4701 | — | 73.55° ($\theta_1$) |
| 16.0 | 10 | .5625 | .5473 | 73.167° ($\theta_2$) |
| 16.5 | 10 | .0152 | — | |

The diagram of FIG. 4a and the above Table A provides sufficient data to solve for distance "a", which distance is indicated by reference numeral 58 in FIGS. 4a–4b, in an oblique triangle abc of FIG. 4b by applying the Law of Sines:

$$\frac{a}{\text{SIN } A} = \frac{b}{\text{SIN } B} = \frac{c}{\text{SIN } C}, \text{ so}$$

$$\frac{a}{\text{SIN } 73.167°} = \frac{b}{\text{SIN } 73.55°}; \text{ but } b = M = .5473, \text{ so}$$

$$\frac{a}{\text{SIN } 73.167°} = \frac{.5473}{\text{SIN } 73.55°} = \frac{a}{.9572} = \frac{.5473}{.9591}, \text{ thus}$$

$$.9609a = .5239, \text{ and } a = \frac{.5239}{.9591} = .5462$$

Since $\theta_1$ and $\theta_2$ are always very nearly equal, but with $\theta_1$ slightly greater as the angle $\theta$ decreases with the horizontal distance X, the lengths "a" and "b" ("b" is the distance M) will similarly be very nearly equal, with "a" very slightly less than "b" (or M). Therefore, for all intents and purposes, a=M as M increases with the distance X. The following formula provides an approximation of M as a function of $\lambda$, although the two earlier equations provide a more accurate value for $M{:}M \cong [\text{SEC } (90° - \theta)\lambda] - (\lambda/2)$.

Considering now the manner in which the angle of the ridges is selected, FIG. 4a illustrates several alternative possibilities with respect to ridge 47, wherein reference numerals 62, 63 and 64 illustrate three different angles. The line 62 represents a radial line which will intersect the focal point 50. This line is based on the assumption that an incoming ray parallel to the axis 44 shown by dashed line 65 will reflect from the surface 43 along the line 62 of ridge 47 and intersect the focal point 50. On the other hand, line 64 represents a ridge which is parallel to the axis 44 of the antenna, and line 63 represents a compromise halfway in between lines 62 and 64. The ridge angle represented by the line 64 assures that no side lobe radiation whatsoever can get into the antenna feed or horn at the focal point 50, but any angle between line 62 and line 64 can be used, particularly as dictated by manufacturing considerations. On the other hand, the angle represented by line 62 appears to be sufficient and preferable inasmuch as this angle likewise will prevent side lobe radiation from reaching the horn or feed at focal point point 50. The line selected generally will be used for each of the ridges of the antenna. The particular angle chosen may be selected for reasons other than just the side lobe radiation consideration, and manufacturing procedures or techniques may come into play as is discussed with respect to FIGS. 8a–8b.

Turning for the moment to FIGS. 8a–8b, these figures schematically represent other forms of the antenna, with FIG. 8a showing a form wherein each parabolic segment reaches the maximum selected dimension Z (such as, 2 cm as described earlier), and in this sense represents an idealized form of antenna. FIG. 8b diagrammatically illustrates another form of the antenna wherein the dimension Z gradually increases. Additionally, these figures illustrate a form of the antenna wherein the surface sections may be formed by stamping from metal and then providing a suitable backing for rigidity. Using the angle 63 of FIG. 4a appears to be best in the event the antenna is stamped from metal, and the shadow area is reduced over that which would exist if the angle 64 were used.

Concerning first FIG. 8a, the same shows an antenna 70 having segments 71–74, etc., ridges 76–79 and a center axis 81. A baseline is indicated at 82, and a maximum excursion for dimension Z is indicated by a line 83. In this form of the antenna, each section is allowed to climb (according to the parabola equation) to the line 83, and is then dropped by the dimension M in the manner previously described. In this case (where each section is allowed to climb to the limit 83 of dimension Z) when the transition M occurs the next succeeding section actually will go below the baseline 82. This results in some flattening of the bases or valleys of the ridges as indicated at 85–88, particularly if the sections 71–74 are formed by stamping from metal. However, this flattening does not harm antenna efficiency because the flattening at 85–88 occurs in a shadow area. Additionally, the angle of the ridges 76–79 can be varied somewhat, as explained previously in connection with the discussion of FIG. 4, which will minimize the flattening. On the other hand, the flattening which occurs at 85–88 can be used advantageously in the event the sections 71–74 are stamped from thin metal since these flattened areas or rings provide suitable surfaces, along with the center portion 89 of the antenna, for spot welding to a flat metal sheet or plate which is represented by the baseline 82 in FIG. 8*a*. Thus, in this form of construction, the segment 71–74 are formed by stamping from thin metal, and the resulting assembly is spot welded at 85–89 to another metal sheet or plate represented by numeral 82. Additionally, it should be noted that the arrangement shown in FIG. 8*a* with the flattened areas 85–88 represents a very efficient use of each of the transitions spaces (at ridges 76–79) since a minimum amount of pressure and mold depth is required in stamping the face sections 71–74 of the antenna 70. Additionally, with the idealized form of antenna in FIG. 8*a* wherein the dimension Z is allowed to reach its chosen limit in each instance, each succeeding section (e.g., 72–73, 74, etc.) is less wide along the X axis than the preceding section.

In the form of the antenna shown in FIG. 8*b*, the baseline 102 is held as a firm baseline, and the dimension Z is allowed to progressively increase for each of the succeeding sections 91–94. As can be seen from FIG. 8*b*, the ridges 97, 98, and 99 rise progressively higher than the Z limit represented by the line 103. This form of the antenna still provides points at the base of the ridges at which spot welding can occur, but these areas are not as large as in the form of antenna illustrated in FIG. 8*a*.

Figure 6:
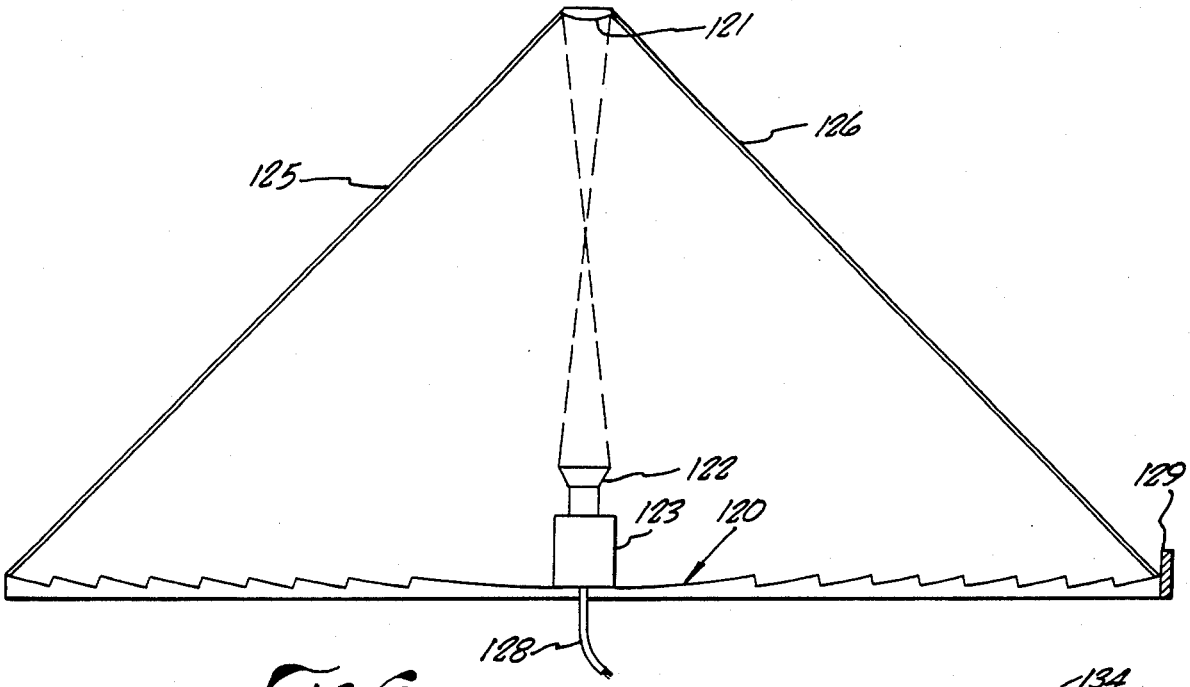
Figure 7:
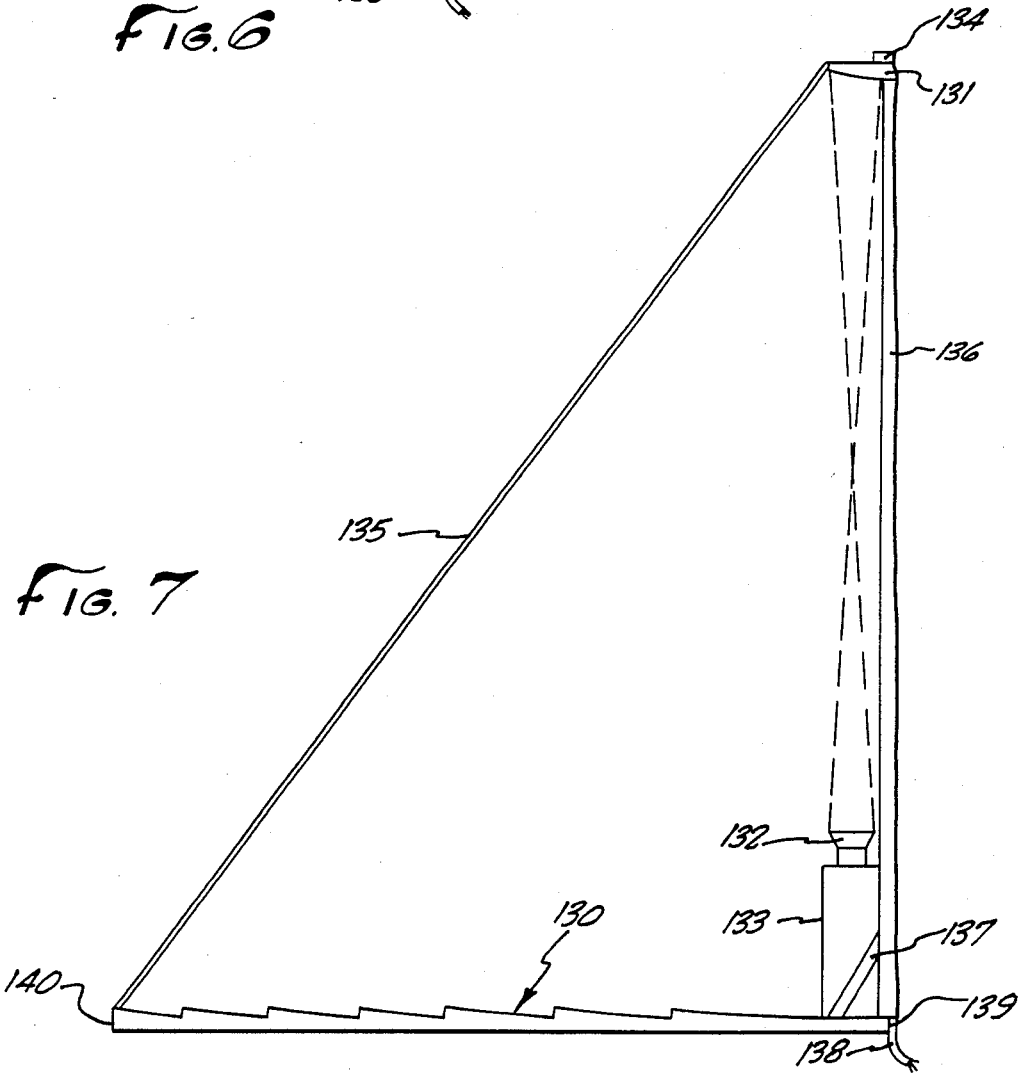

FIGS. 5 through 7 illustrate several arrangements for the feed horn used with antennas according to the present invention. In FIG. 5 the antenna of the present invention is shown at 110, along with an upper reflector 111, feed horn 112 and down converter 113. The reflector 111 may be supported by several (e.g., three to four) support struts indicated at 115–116, and the feed horn and down converter 112–113 can be supported by a rigid conduit 117 secured in any suitable manner to the center of the antenna 110 (or extending therethrough to a suitable support bracket, not shown). Numeral 118 designates a feed cable connected with the down converter 113 and for connection to a television front end or other suitable high frequency processing equipment. The reflector 111 preferably is slightly convex so as to spread the reflected rays with respect to the feed horn and antenna. The antenna shown has a focal length of 1*d*, where d is the diameter of the antenna.

FIG. 6 illustrates an arrangement similar to FIG. 5 comprising an antenna 120 reflector 121, feed horn 122, down converter 123, several support struts 125–126 and feed cable 128. The focal length is 0.5d. In this arrangement, the down converter 123 and feed horn 122 are mounted at or near the center surface of the antenna 120. It should be noted that in the case of the arrangements of FIG. 5 and FIG. 6 a typical square feed horn matches better with a square form of the present antenna as shown in FIGS. 1 and 2 than a conventional circular antenna. Additionally, a short cylinder, indicated diagrammatically at 129, can be disposed around the outer periphery of the antenna of FIG. 5 or FIG. 6 for further reducing problems with respect to side lobe radiation.

FIG. 7 illustrates another feed arrangement for an antenna of the present invention, but in this case the antenna 130 comprises only a half section (from the center line at 139 to the outer edge at 140). While the antenna 130 could be circular or have other shapes, it preferably is square or rectangular so as to better match the characteristics of a square feed horn 132. In this construction, the upper reflector 131 is supported by a bracket 134 affixed to a rigid support member 136, and is supported by a strut 135 if necessary. A bracket 137 can be provided for the down converter 133 and feed horn 132. The antenna shown has a focal length of 0.75d.

The antenna of the present invention can be manufactured in various manners as earlier described. Additionally, it could be formed by grinding or turning a blank to the required configuration, milled, or formed in other ways. In the event the antenna is formed by stamping the sections from metal, no particular surface finish should be necessary other than a suitable weatherproofing coating such as paint. In the event the antenna is formed by molding of a plastic or resin material, it may be coated in any of many ways, by spraying, dipping, and the like. The low profile of the antenna reduces wind loading, and its configureation is more susceptible to using an airfoil or the like at the side of the antenna to further reduce the wind loading, none of which can be accomplished readily with a parabolic antenna. Because of the thinness or low profile of the antenna it is relatively flat and therefore is quite susceptible of cutting into two or more sections, packaging and shipping, and reassembling at point of installation. It further should be noted that at lower selected frequencies the antenna becomes larger and, thus, the primary use for an antenna according to the present invention appears to be at frequencies around one gigahertz and above. While the antenna of the present invention has been described mainly with respect to reception of high frequency signals, it also can be used as a transmitting antenna as noted earlier. Additionally, the form of the antenna can be used as a frequency selecting reflecting telescope, such as for spectroastronomy, laser uses, and the like.

While preferred embodiments of the present invention have been described and illustrated, various modifications will be apparent to those skilled in the art and it is intended to include all such modifications and variations within the scope of the appended claims.

What is claimed is:

1. A high frequency reflective antenna which is preferentially frequency selective at a design frequency of a given frequency or narrow range of frequencies, comprising a plurality of adjacent antenna sections comprising a central section and substantially concentric sections disposed radially outward from the central section, each section having a parabolic surface of different focal length, and each concentric section being offset with respect to the next preceding section by a distance M in a direction substantially parallel to the central axis of the antenna, where M is greater than one-half wavelength but not a precise multiple of one-half wavelength or of one wavelength of the design frequency of the antenna and M progressively increases for each succeeding concentric section.

2. An antenna as in claim 1 including a first circular central section, and succeeding sections in the form of concentric rings.

3. An antenna as in claim 2 wherein edges of outer sections of the antenna are cut off to form a rectangular antenna.

4. An antenna as in claim 1 including feed horn means mounted with respect to the parabolic surfaces of said antenna and wherein the antenna reflects radiation to or from the feed horn.

5. An antenna as in claim 1 wherein said antenna has a central axis and a prime focal length along said axis from the center of the surface of the antenna to a focal point, and wherein each succeeding section has a focal length measured at said axis at an even multiple of one-half the wavelength of the design frequency of the antenna.

6. A frequency selective reflective antenna which is preferentially frequency selective at a given frequency or narrow range of frequencies, comprising a plurality of adjacent antenna sections, comprising a first circular central section, and succeeding sections in the form of concentric rings, each section having a parabolic surface of different focal length, and each succeeding section being offset with respect to the next preceeding section in a direction substantially parallel to the central axis of the antenna by a distance M, where M is greater than one-half wavelength but not a precise multiple of one-half wavelength or of one wavelength at said given frequency and M progressively increases for each succeeding section.

7. An antenna as in claim 6 wherein said antenna sections are formed of metal by stamping.

8. A high frequency reflective antenna which is preferentially frequency selective at a design frequency of a given frequency or narrow range of frequencies, comprising a plurality of adjacent antenna sections, each section having a parabolic surface of different focal length, and each section being axially offset with respect to the next preceding section by an axial distance M, where M is greater than one-half wavelength of the design frequency of the antenna and M progressively increases for each succeeding section, and where M is defined by the following equation, $$M = \frac{X^2}{4F_{Ln-1}} - \frac{X^2}{4F_{Ln}} + \Delta F_L,$$

where

X is the radial distance from the axis to a respective section, $F_L$ is the focal length of the respective ($n^{th}$) section, n is the number of the section, and $\Delta F_L$ is the change in axial focal length from one section to the next and is an even multiple of one-half of the wavelength of the design frequency.

9. A frequency selective reflective antenna which is preferentially frequency selective at a given frequency or narrow range of frequencies, comprising a plurality of adjacent antenna sections, comprising a first circular central section, and succeeding sections in the form of concentric rings, each section having a parabolic surface of different focal length, and each section being offset with respect to the next preceding section in an axial direction by a distance M parallel to the axis of the antenna, where M is greater than one-half wavelength at said given frequency and M progressively increases for each succeeding section, and where the edges of the outer sections of the antenna are cut off to form a rectangular antenna, and where M is defined by the following equation, $$M = \frac{X^2}{4F_{Ln-1}} - \frac{X^2}{4F_{Ln}} + \Delta F_L,$$

where

X is the radial distance from the axis to a respective section, $F_L$ is the focal length of the respective ($n^{th}$) section, n is the number of the section, and $\Delta F_L$ is the change in axial focal length from one section to the next and is an even multiple of one-half of the wavelength of the design frequency.

10. A frequency selective reflective antenna which is preferentially frequency selective at a given frequency or narrow range of frequencies, comprising a plurality of adjacent antenna sections, comprising a first circular central section, and succeeding sections in the form of concentric rings, each section having a parabolic surface of different focal length, and each section being offset with respect to the next preceding section in an axial direction by a distance M parallel to the axis of the antenna, where M is greater than one-half wavelength at said given frequency and M progressively increases for each succeeding section, and where the edges of the outer sections of the antenna are cut off to form a rectangular antenna, and where M is defined by the following equation, $$M = \frac{X^2}{4F_{Ln-1}} - \frac{X^2}{4F_{Ln}} + \Delta F_L,$$

where

X is the radial distance from the axis to a respective section, $F_L$ is the focal length of the respective (nth) section, n is the number of the section, $\Delta F_L$ is the change in axial focal length from one section to the next and is an even multiple of one-half of the wavelength of the design frequency, and feed horn means mounted with respect to the parabolic surfaces of said antenna and wherein the antenna reflects radiation to or from the feed horn means.

11. An antenna as in claim 8 wherein said antenna has the following characteristic, $F_{Lo}/D \geqq 0.4$, where $F_{Lo}$ is the prime focal length and D is the diameter of said antenna.

12. A high frequency reflective antenna which is preferentially frequency selective at a design frequency of a given frequency or narrow range of frequencies, comprising a plurality of adjacent antenna sections, a first circular central section and succeeding sections in the form of concentric rings, each section having a parabolic surface of different focal length, and each succeeding section being offset with respect to the next preceding section by a distance M in a direction substantially parallel to the central axis of the antenna, where M is greater than one-half wavelength but not a precise multiple of one-half wavelength or of one wavelength of the design frequency of the antenna and M progressively increases for each succeeding section, and said antenna has the following characteristic, $F_{Lo}/D \geqq 0.4$, where $F_{Lo}$ is the prime focal length and D is the diameter of said antenna.

13. A high frequency reflective antenna which is preferentially frequency selective at a design frequency of a given frequency or narrow range of frequencies, comprising a plurality of adjacent antenna sections, a first circular central section and succeeding sections in the form of concentric rings, each section having a parabolic surface of different focal length, and each succeeding section being offset with respect to the next preceding section by a distance M in a direction substantially parallel to the central axis of the antenna, where M is greater than one-half wavelength but not a precise multiple of one-half wavelength or of one wavelength of the design frequency of the antenna and M progressively increases for each succeeding section, and M is approximately equal to $[\mathrm{SEC}\ (90°-\theta)\lambda]-(\lambda/2)$, where $\lambda$ is the wavelength in centimeters at the design frequency of the antenna and $\theta$ is the angle of the surface of each succeeding section with respect to the central axis of the antenna.

* * * * *